US009857127B2

(12) United States Patent
Al-Otaibi

(10) Patent No.: US 9,857,127 B2
(45) Date of Patent: Jan. 2, 2018

(54) HEADER FOR AIR COOLED HEAT EXCHANGER

(71) Applicant: Saudi Arabian Oil Company, Dhahran (SA)

(72) Inventor: Dhawi A. Al-Otaibi, Jalawaih (SA)

(73) Assignee: Saudi Arabian Oil Company, Dhahran (SA)

( * ) Notice: Subject to any disclaimer, the term of this patent is extended or adjusted under 35 U.S.C. 154(b) by 741 days.

(21) Appl. No.: 13/692,294

(22) Filed: Dec. 3, 2012

(65) Prior Publication Data

US 2013/0140012 A1 Jun. 6, 2013

Related U.S. Application Data

(60) Provisional application No. 61/567,433, filed on Dec. 6, 2011.

(51) Int. Cl.

| | |
|---|---|
| ***F28F 17/00*** | (2006.01) |
| ***F28F 9/02*** | (2006.01) |
| ***F28D 7/06*** | (2006.01) |

(52) U.S. Cl.

CPC ..... *F28F 9/0202* (2013.01); *F28D 7/06* (2013.01); *F28F 17/00* (2013.01)

(58) Field of Classification Search

CPC ..... F28F 9/0202; F28F 17/00; F28F 9/02

USPC ..... 165/174, 176, 110

See application file for complete search history.

(56) References Cited

U.S. PATENT DOCUMENTS

| | | | | | |
|---|---|---|---|---|---|
| 1,884,080 | A | * | 10/1932 | Miller | F28F 9/0219 165/176 |
| 2,556,632 | A | | 6/1951 | Powell | |
| 2,954,213 | A | | 9/1960 | Pellegrini | |
| 3,283,943 | A | * | 11/1966 | Italo Cargnelutti | 206/509 |
| 3,902,599 | A | * | 9/1975 | Stromberg | 206/511 |
| 4,139,053 | A | | 2/1979 | Schaal | |
| 4,422,499 | A | | 12/1983 | Batistoni | |
| 4,449,692 | A | | 5/1984 | Rhodes | |

(Continued)

FOREIGN PATENT DOCUMENTS

| | | | |
|---|---|---|---|
| EP | 1457366 | * | 9/2004 |
| FR | 2399716 | | 3/1979 |

(Continued)

OTHER PUBLICATIONS

Biryukov, SU1089353TRANS (English Translation), Apr. 1984.*

(Continued)

*Primary Examiner* — Justin Jonaitis
*Assistant Examiner* — Eric Ruppert
(74) *Attorney, Agent, or Firm* — Abelman, Frayne & Schwab

(57) ABSTRACT

A header for an air cooled heat exchanger is provided. The header includes a housing having top and bottom walls and side walls and an inlet and an outlet, one of said side walls being a tube wall for connection to a plurality of heat exchanger tubes. The header includes a partition wall between the top and bottom walls defining upper and lower regions, the partition being a sheet having a higher central area which extends downward to corners of the upper region. Each corner has a drain aperture for fluid in the upper region to drain by gravity out of the upper region.

12 Claims, 3 Drawing Sheets

(56) References Cited

U.S. PATENT DOCUMENTS

Figure 1:
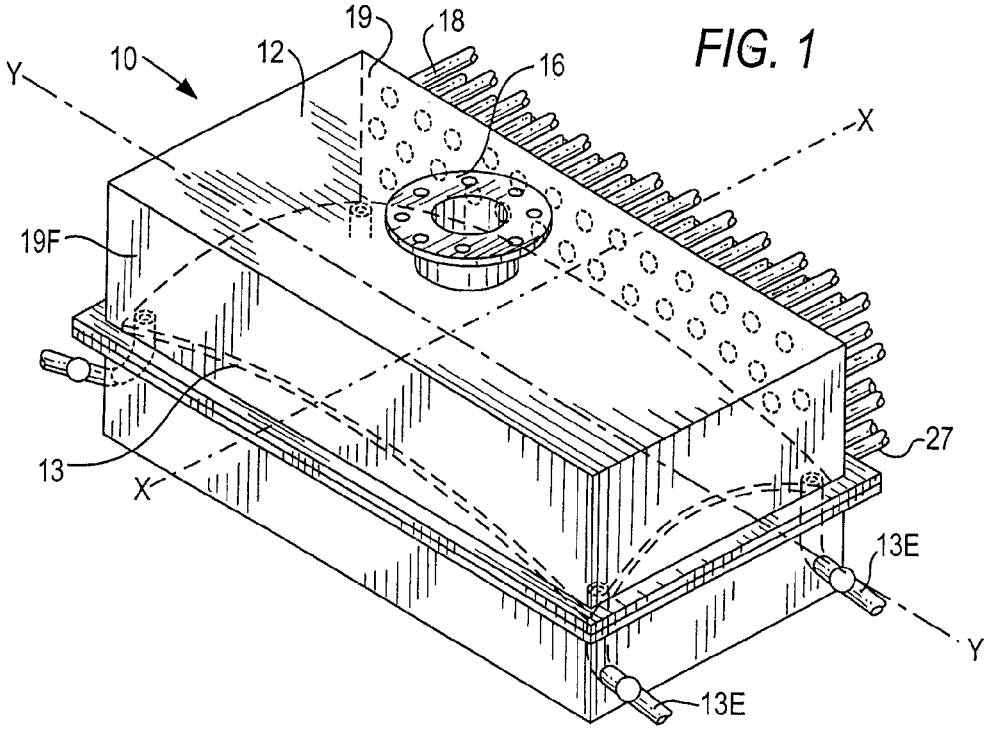

| | | | | | |
|---|---|---|---|---|---|
| 4,519,450 | A * | 5/1985 | Kals | F28B 1/00 | 165/114 |
| 4,621,679 | A | 11/1986 | Byers et al. | | |
| 4,621,686 | A * | 11/1986 | Ahn | 165/113 | |
| 4,738,306 | A | 4/1988 | Tamba et al. | | |
| 2007/0039824 | A1* | 2/2007 | Salbilla | 204/555 | |
| 2010/0263845 | A1* | 10/2010 | Fujiwara | 165/157 | |

FOREIGN PATENT DOCUMENTS

| | | | |
|---|---|---|---|
| GB | 312470 | * | 5/1929 |
| JP | H06294594 | * | 10/1994 |
| SU | 1089353 | * | 4/1984 |

OTHER PUBLICATIONS

Yasuda, JPH06294594TRANS (English Translation), Oct. 1994.*
IPRP and Written opinion of the Int'l. Searching Authority; dated Jun. 10, 2014.

* cited by examiner 10
12
19
18
16
Y
X
19F
13
X
27
13E
Y
13E 4
19
16
12
18
10
13E
3
3
19F
13E
4

HEADER FOR AIR COOLED HEAT EXCHANGER

I. CROSS-REFERENCE TO RELATED APPLICATION

This application claims the benefit of U.S. Provisional Application No. 61/567,433, filed Dec. 6, 2011, which is hereby incorporated by reference.

II. FIELD OF THE INVENTION

This invention is in the field of air cooled heat exchangers and particularly headers for heat exchange tubes in an air cooled heat exchangers.

III. BACKGROUND AND PRIOR ART

Large chemical processing plants utilize a great many tube type heat exchangers which typically include bundles of heat exchange tubes whose ends are coupled to a header. To comply with stringent safety procedures and also for normal efficient operation, the header components of heat exchangers and tubes are periodically subjected to hydrostatic leak testing, at least twice, once after fabrication at the manufacturing site and secondly before plant startup in the field to ensure that the joints are free of defects and leakage. After the heat exchangers are tested and the results accepted, the heat exchangers are drained of water to ensure that internal header surfaces and tubes are dry. Drying may be done by hot air or inert gas. The purpose of internal surface drying is to prevent internal corrosion that might be caused after water testing during shipment and in standby operation mode. Such testing is necessary to avoid catastrophic joint leaks, and obviously to detect and correct or monitor even small leaks.

Conventional headers of air cooled heat exchangers are designed as closed boxes, each containing a plug sheet, tubesheet, end plates, top and bottom plate, nozzles, stiffeners and partition plates. Due to the complexity of air cooled heat exchanger headers which include corners and undercut regions, complete water draining and drying is not achieved with current drying procedures. Such accumulated moisture and water during shipment and in standby operation mode becomes stagnant and then corrosive, causing severe damage to internal parts of the headers and to adjacent parts of tubes coupled to the headers. Consequently, tube sheets and the heat exchange tubes themselves are at risk of damage which is not only expensive to repair, but causes shutdown of the whole heat exchanger. When such periodic inspection of headers results in repair or replacement and in many heat exchangers being taken out of line, costs in large chemical treatment plants can have production losses reaching $300,000 per day due to downtime.

The present invention addresses this severe problem with a new design for headers intended to extend equipment cycle life and prevent unexpected failures due to corrosion.

IV. SUMMARY AND OBJECTS OF THE INVENTION

A first object of the present invention is to design a new header structure that provides better drainage of water that is used in hydrostatic testing and that will leave internal surfaces of the headers dry without traditional water stagnation and corrosion.

Another object of the present invention is to provide a new header structure for air cooled heat exchangers where in-flow is into a space that includes a floor partition that is bent downward at its four corner regions to provide gravity drain into a drain pipe at each corner of hydrostatic testing water.

A further object of the present invention is for said partition floor area to be formed of a plate having all four side edges each define a convex curve highest at the center and descending to the four corners. The curvature may be about a single axis thus developing a fragment of a straight cylinder, or may be about two perpendicular axes developing an umbrella-like roof.

A still further object of the invention described above is for the floor to be a generally continuous sheet.

Another object of the invention described above is to provide a generally box shaped header where one side wall comprises a tube sheet through which a plurality of heat exchange tubes are coupled.

An additional object is to provide a method for reducing accumulation of stagnated water in a header of an air cooled heat exchanger by forming the floor of the inlet chamber to have a continuous downward curvature to all four corners from which further downward extending drain ducts.

Accordingly, another object is to provide a header for an air cooled heat exchanger comprising: (a) a housing having top and bottom walls and side walls and an inlet and an outlet, one of said side walls being a tube wall for connection to a plurality of heat exchanger tubes; (b) a partition wall between said top and bottom walls defining upper and lower regions, said partition being a sheet having a higher central area which extends downward to corners of said upper region; and (c) each corner having a drain aperture for fluid in said upper region to drain by gravity out of said upper region.

Accordingly, another object is to provide a heat exchanger comprising: (a) a header box having walls including a top, a bottom, and four sides; (b) a partition wall positioned within the box between the top and bottom walls defining an upper portion of the box and a lower portion of the box, the partition wall having a higher central area which extends downward to four corner regions; (c) each corner region having a drain aperture for fluid in the upper portion to drain by gravity out of the upper portion; (d) a return header; and (e) a plurality of heat exchange tubes connected between one side wall of the box and the return header, wherein an upper portion of the heat exchange tubes carry fluid from the upper portion of the box and wherein a lower portion of the heat exchange tubes carry fluid into the lower portion of the box; wherein during operation of the heat exchanger, fluid flows into the upper portion of the box via an inlet, which then flows into the upper heat exchange tubes, which then passes through the return header, which then flows into the lower heat exchange tubes, which then flows into the lower portion of the box, and which then flows out of the box via an outlet.

V. BRIEF DESCRIPTION OF THE DRAWINGS

Figure 2:
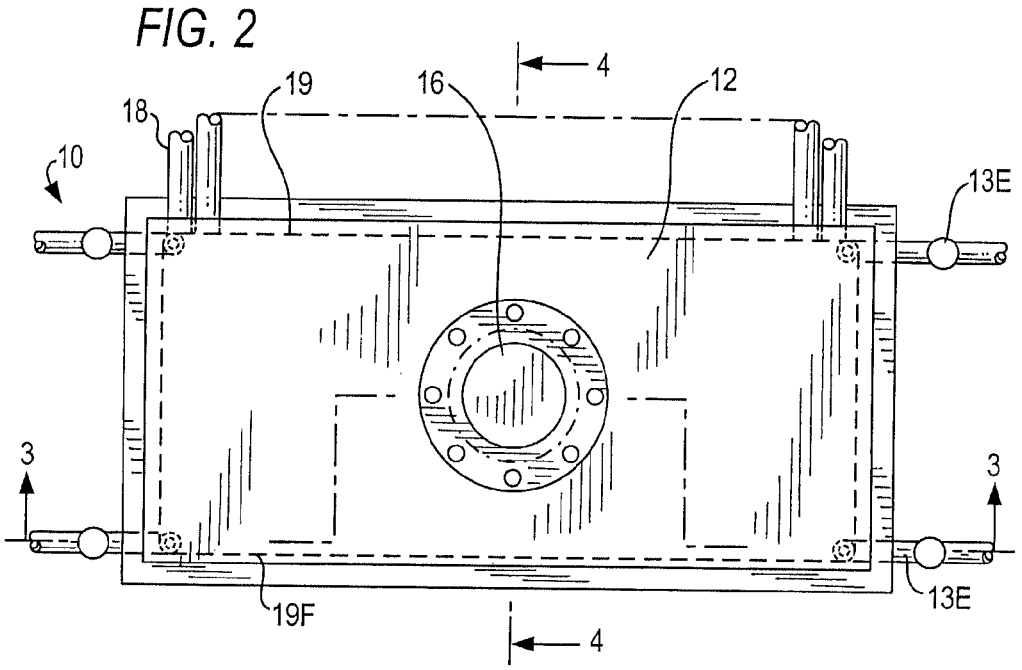
Figure 3:
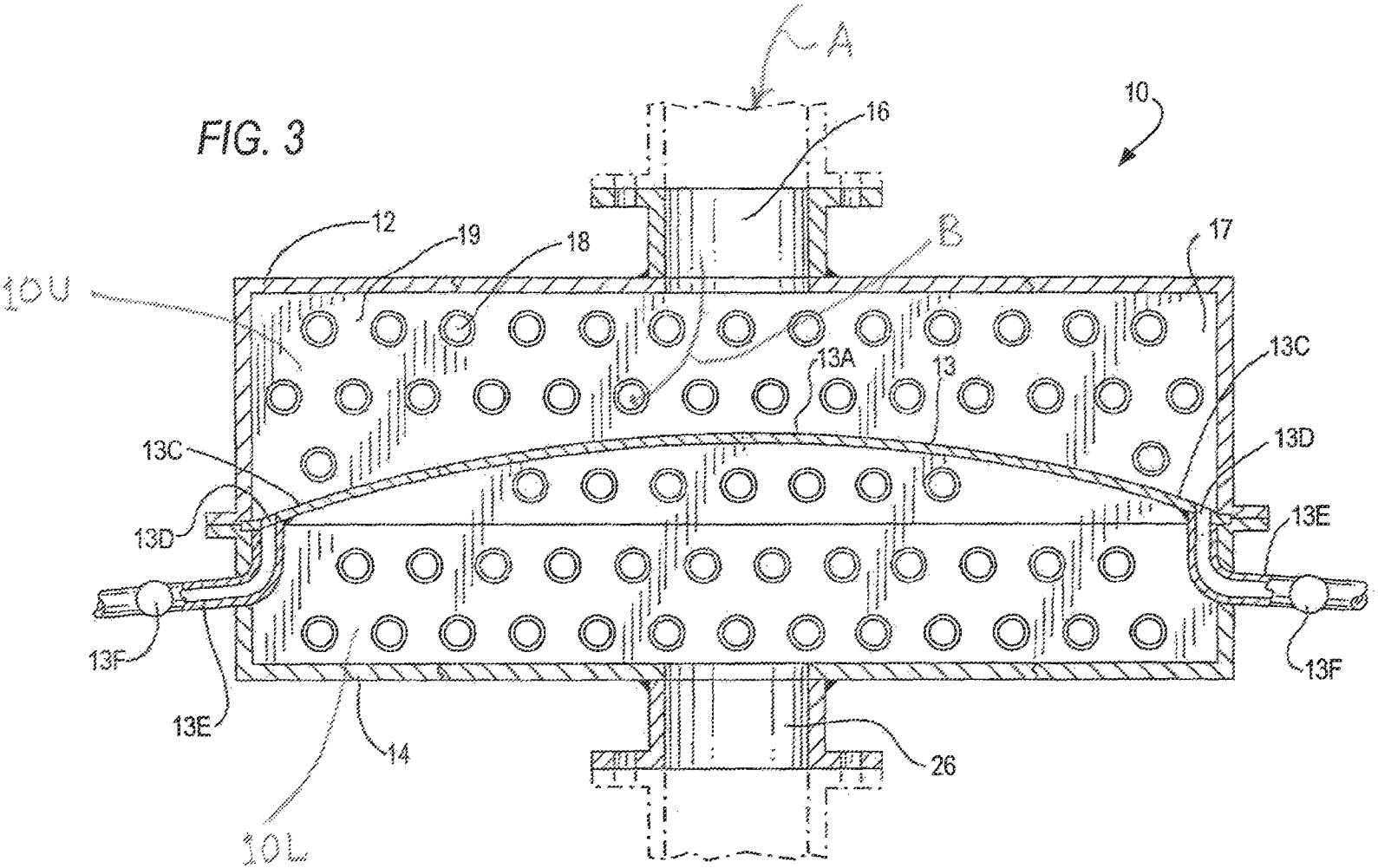
Figure 4:
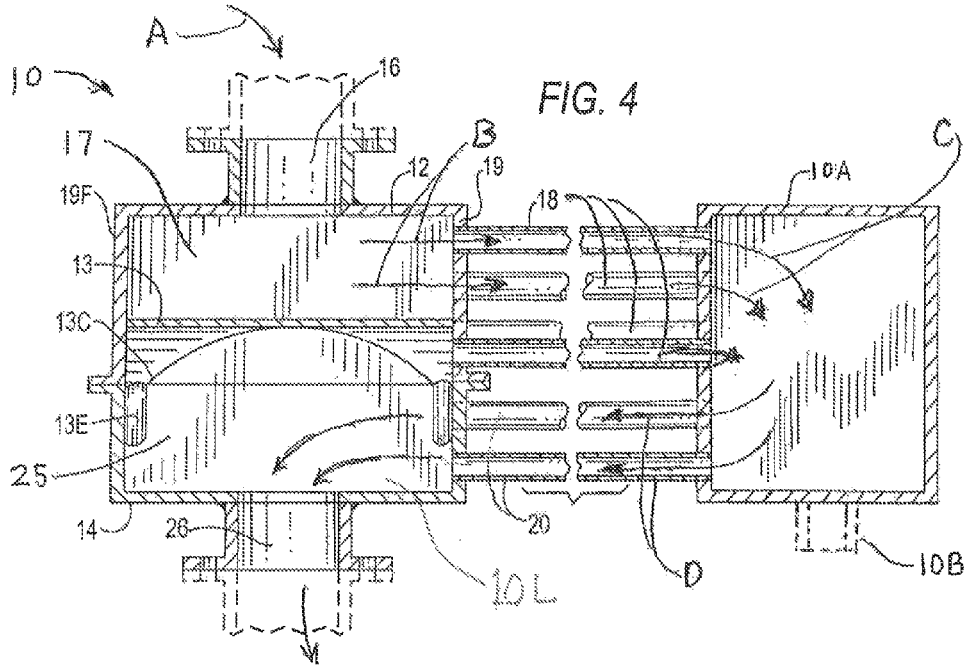
Figure 5:
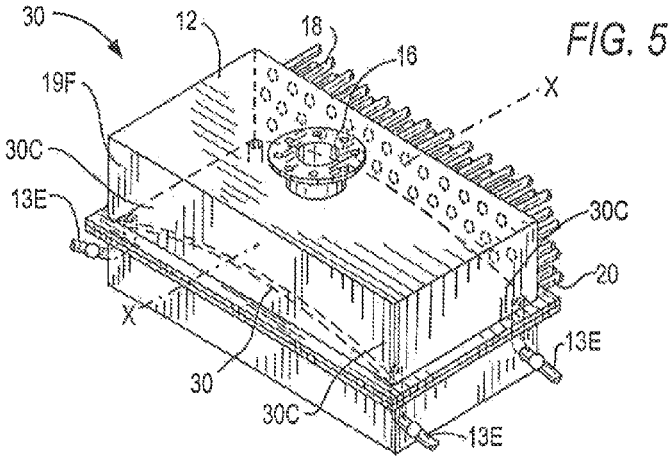

FIG. 1 is a top front perspective view of the new header for an air cooled heat exchanger, FIG. 2 is a top plan view of the header of FIG. 1, FIG. 3 is a sectional view taken along line 3-3 in FIG. 2, FIG. 4 is a side elevation view in section taken along line 4-4 in FIG. 2 which includes a return header, and FIG. 5 is a top front perspective view similar to FIG. 1 of a second embodiment of the new header.

VI. DETAILED DESCRIPTION OF THE PREFERRED EMBODIMENT

FIGS. 1-4 illustrate a first embodiment of the new header construction for use with an air cooled heat exchanger (ACHE). The header 10 is shown in FIG. 1 with heat exchange tubes 18 as a bundle coupled to the rear wall or tubesheet 19 in the upper portion 10U of header 10, and the additional heat exchange tubes 20 also coupled to tube sheet 19 in the lower portion 10L thereof. As seen in FIGS. 1 and 3 header 10 is formed in a box shape housing having top wall 12, bottom wall 14, rear wall or tubesheet 19 and front wall 19F. Also shown in FIGS. 1, 3 and 4 is inlet 16 for receiving fluid indicated by arrow A into area or zone 17 in the upper portion 10U of the header, which then flows into upper heat exchange tubes 18 indicated by arrow B, which then passes through a return header 10A indicated by arrows C, which then flows into lower heat exchange tubes 20 indicated by arrows D, which then flows into the area or zone in the lower portion 10L of the header, and which then flows out of the header via the outlet 26. A variation of the FIG. 4 heat exchanger could omit the return tubes 20 and employ in header 10A an outlet 10B as indicated in dashed line, and still other arrangements are possible with the new header 10.

In FIGS. 1-4 upper zone 17 of header 10 is bounded at the bottom by a partition plate 13 which plate is curved to have a higher elevation portion 13A in the central region, with the four corners bent downward in regions 13C, see FIGS. 3 and 4. As seen in FIG. 1 sheet 13 has two opposite sides curved downward about an X-axis and the other two opposite sides curved downward about a Y-axis, creating an umbrella-like roof. The downward curvature is about 10 mm per meter or about ⅛ inch per foot of length, creating an angle of about 0.6° downward from the central area 13A. At each corner 13C is an opening 13D to a drainage tube 13E that extends downward from the header's upper portion 10 above partition 13 and bi-passes the header's lower portion 10L below partition 13.

Cleaning water or other fluid which enters inlet 16 and then flows to tubes 18, would typically leave moisture residue in the corners and other areas of zone 17. In the new header such residue moisture and/or liquid is automatically drained to the four corners 13C and out drain holes 13D which are about ¼ to ½ inch in diameter, to which are welded corresponding drain tubes 13E. Partition sheet 13 may serve additionally as a stiffener plate as it is welded to the four sides of the header box to strengthen same. Each drain tube 13E has its own valve 13F to be closed when the system is in operation or testing has been terminated. The header in FIGS. 1-4 to which the tubes are connected is typically about two meters wide, with end plates 30 and 31 that are typically about one half meter wide.

FIG. 5 illustrates a second embodiment 30 of the new header which differs from the above-described first embodiment only as regards the curved form of its partition 30 which is curved only about X-axis, but still has all its four corners 30C at the lowest elevation for gravity drainage to its drain ducts 30E.

While the invention has been described in conjunction with several embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. An inlet header for an air cooled heat exchanger which includes a plurality of heat exchange tubes for receiving a fluid to be cooled, said inlet header comprising:

a housing having top, bottom and side walls which define within said walls a chamber, a partition wall positioned within said housing between said top and bottom walls and defining an upper portion of said chamber with an inlet thereto and a separate lower portion of said chamber with an outlet therefrom, said partition wall having a central area and extending laterally to its peripheral edges that are sealed with said housing side walls, all said peripheral edges being at a lower elevation than said central area, and a plurality of drain apertures that extend downward and are spaced apart from each other at said peripheral edges of said partition for fluid in said upper portion to drain by gravity out of said upper portion of said chamber while by-passing said lower portion of said chamber.

2. The header of claim 1, wherein said housing is generally rectangular with four corner regions, and said partition wall is a rectangular plate having four peripheral side edges, wherein each of said side edges defines a convex curve highest at its center, said partition wall descending from its highest center to four corners situated at said corner regions of said housing, and said drain apertures are located in said corner regions of said upper portion of said chamber near said corners of said partition wall.

3. The header of claim 2 where two opposite side edges of said partition wall define a convex curvatures highest at their center areas about a first axis and two other opposite side edges of said partition wall define convex curvatures highest at their center areas about a second axis perpendicular to said first axis.

4. The header of claim 2, wherein said downward convex curvature is 10 mm per meter or ⅛ inch per foot of length.

5. The header of claim 1, wherein the partition wall is formed from a generally continuous plate.

6. The header of claim 1, wherein one side wall of said housing is a tube sheet having a plurality of apertures, each aperture adapted to receive and be coupled to one end of a heat exchange tube.

7. The header of claim 6, wherein said tube sheet has an upper part with apertures for fluid to exit said housing, and a lower portion with apertures for fluid to enter said housing.

8. The header of claim 1, wherein each drain aperture has a diameter of ¼ to ½ inch.

9. The header of claim 1, wherein each drain aperture extends downward through said partition.

10. The header of claim 9, further comprising valves connected with each drain tube, respectively, wherein said valves are adapted to be closed when said header is in operation and wherein said valves are adapted to be opened to drain fluid by gravity out of the upper portion.

11. The header of claim 1, wherein the partition wall is welded to the four side walls of the box.

12. An air cooled heat exchanger which has a plurality of heat exchange tubes for receiving a fluid therethrough, and which may be subject to hydrostatic testing that leaves residue fluid in the inlet header, said air cooled heat exchanger comprising:

a. an inlet header, b. a return header, and c. a plurality of heat exchange tubes in fluid connection between said inlet and return headers, said inlet header comprising:

(1) a housing having top, bottom and side walls which define within said walls a chamber with an inlet to said chamber, (2) a partition wall positioned within said housing between said top and bottom walls and defining an upper portion of said chamber with an inlet to said upper portion, and a separate lower portion of said chamber with an outlet from said lower portion, said partition wall having a central area and extending laterally to its peripheral edges that are sealed with said housing side walls, all said peripheral edges being at a lower elevation than said central area, and (3) a plurality of drain apertures that extend downward and are spaced apart from each other at said peripheral edges of said partition for said residue fluid from said hydrostatic testing in said upper portion of said chamber to drain by gravity out of said upper portion of said chamber while by-passing said lower portion, said plurality of heat exchange tubes comprising a first bundle of said heat exchange tubes adapted to carry fluid from said upper portion of said housing to said return header, and said second bundle of said heat exchange tubes adapted to carry fluid from said return header to said lower portion of said chamber, wherein during operation of said heat exchanger, fluid flows into said upper portion of said chamber via said inlet, then flows through said first bundle of tubes to said return header, then flows via said second bundle of tubes to said lower portion of said chamber and exits via said outlet.

* * * * *